United States Patent [19]

Nishikawa et al.

[11] Patent Number: 4,565,047

[45] Date of Patent: Jan. 21, 1986

[54] APPARATUS FOR PACKAGING FOLDED HOSIERY

[75] Inventors: Masao Nishikawa, Katsuragi; Seiichi Saibe, Kashihara, both of Japan

[73] Assignees: Monarch Knitting Machinery Corporation, Glendale, N.Y.; Takatori Machinery Mfg. Co., Ltd., Osaka, Japan

[21] Appl. No.: 531,342

[22] Filed: Sep. 12, 1983

[30] Foreign Application Priority Data

Sep. 18, 1982 [JP] Japan ..... 57-162734

[51] Int. Cl.[4] ..... B65B 9/08; B65B 25/20

[52] U.S. Cl. ..... 53/137; 53/258; 53/562; 156/521

[58] Field of Search ..... 53/117, 129, 137, 258, 53/376, 377, 415, 416, 429, 455, 459, 469, 480, 562, 570; 229/79, 80; 383/84, 86; 156/521

[56] References Cited

U.S. PATENT DOCUMENTS

| | | | |
|---|---|---|---|
| 3,448,557 | 6/1969 | Swaithes | 53/117 |
| 3,742,676 | 7/1973 | Lawing et al. | 53/117 X |
| 3,975,888 | 8/1976 | Jones | 53/562 X |
| 4,026,754 | 5/1977 | Bogdanski et al. | 156/521 |
| 4,379,384 | 4/1983 | Nishikawa | 53/415 |

*Primary Examiner*—Robert L. Spruill
*Assistant Examiner*—Michael D. Folkerts
*Attorney, Agent, or Firm*—Nathan Levin

[57] ABSTRACT

An apparatus for automatically packaging folded hosiery into a pouch having a pouch closing flap in which a first means automatically forms the pouch and flap of a single sheet of plastic film with one face of a double-faced adhesive tape adhesively attached to the pouch, in which a second means automatically inserts the folded hosiery into the pouch while adhesively attaching the other face of the double-faced adhesive tape already on the pouch to the flap to close the pouch with the hosiery therein and in which a suction transfer arm automatically transfers the pouch and flap as made by the first means to the second means to insert the hosiery into the pouch.

13 Claims, 9 Drawing Figures

Figure 1:
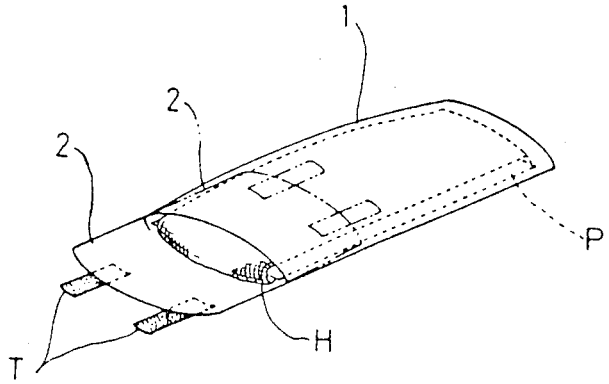
Fig. 1. (Prior Art)

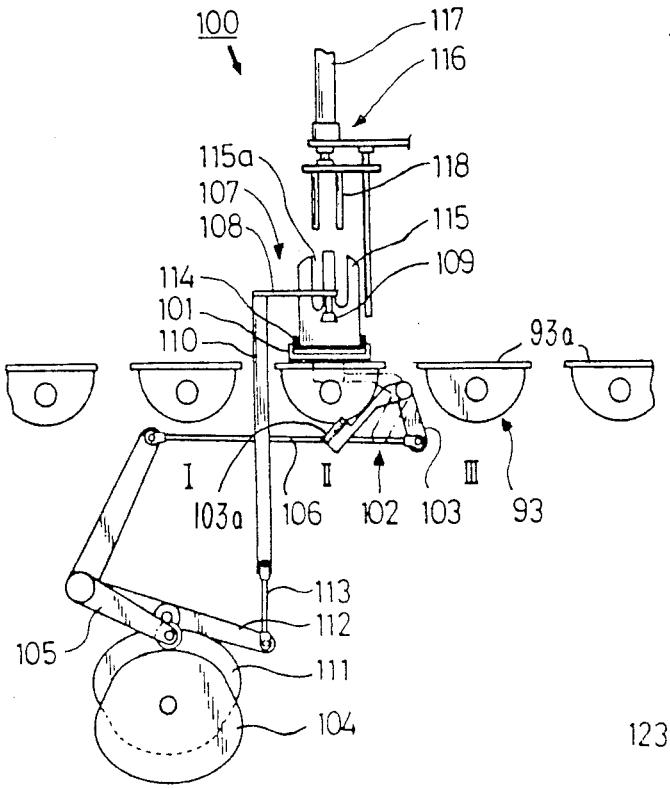
Fig.7.
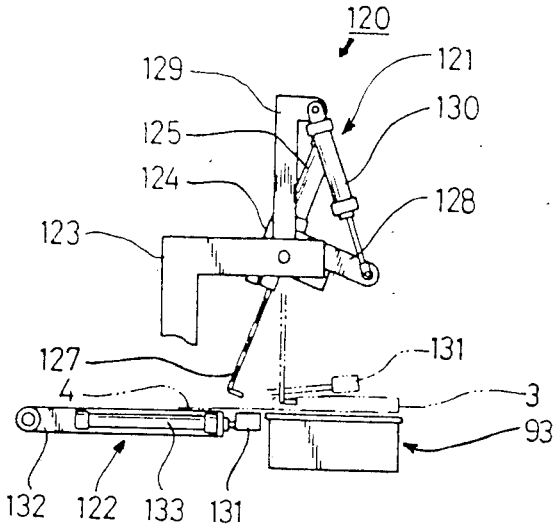
Fig. 8.
Fig.9.
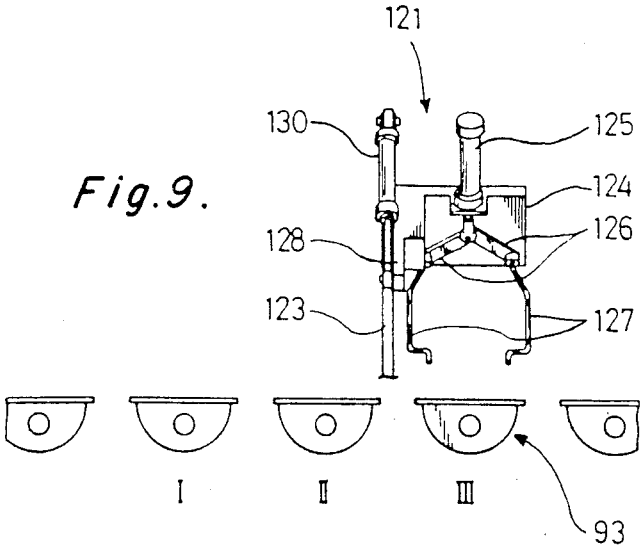

APPARATUS FOR PACKAGING FOLDED HOSIERY

The present invention relates generally to the art of packaging and more particularly to apparatus and method for the formation of pouches with flaps therefor of plastic film and for the insertion of folded hosiery into the pouches and for closing the flaps thus to package the hosiery within the closed pouch.

The pouches are formed of individual transversely severed sections of a lengthwise extending ribbon-like plastic film of indefinite length which is doubled or folded back on itself along a lengthwise extending fold line so placed that there is a double wall of film extending from the fold line and a single wall of film in extension of one of the double walls. Joining the doubled walls forms pouches having an opening therebetween and a flap therefore formed of the extension of one of the walls.

The present apparatus provides substantially square shaped pouches of litte depth into which the folded hosiery is inserted and in which the closing flaps may be shaped as desired to provide an enhanced appearance for the package. In the present apparatus sections of double faced adhesive tape are stuck at selected intervals to the non-flap side of the folded over plastic film prior to the formation of the pouches so that after the pouches are made and transferred to a position in which the hosiery is inserted therein, the flap is turned toward the pouch to contact the adhesive tape and be bonded to the pouch for sealing thereto. The tape is hidden from view between the pouch and the closing flap.

Known apparatus forms individual pouches by heat cutting and sealing transverse sections of the folded back plastic film in a single step, then transfers the pouches onto a conveyer to a hose inserting position, then inserts the folded hosiery into the pouches, then sticks an adhesive tape or two to the flaps of the pouches and turns the flaps to the pouches for sealing the flaps thereto.

While such known apparatus may be generally satisfactory for flat pouches of rectangular shape, it is not satisfactory for the square shaped pouches of little depth desired to be made by the present invention, as will be detailed in the specification.

It is the principal object of the present invention to provide an apparatus for the formation of substantially square shaped pouches of little depth.

It is a further object to heat seal the juncture line between adjoining pouches and to sever such junctions after severing the plastic film to form the flaps.

With the above and other objects in view as will appear from the accompanying drawings and the description thereof, the invention resides in the apparatus and method for the formation of pouches and flaps therefor of plastic film and the insertion of folded hosiery into the pouches and for closing the flaps with the hosiery therein as shown and described and set forth in the appended claims.

Figure 2:
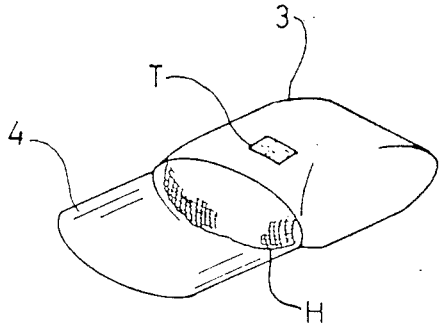
Figure 3:
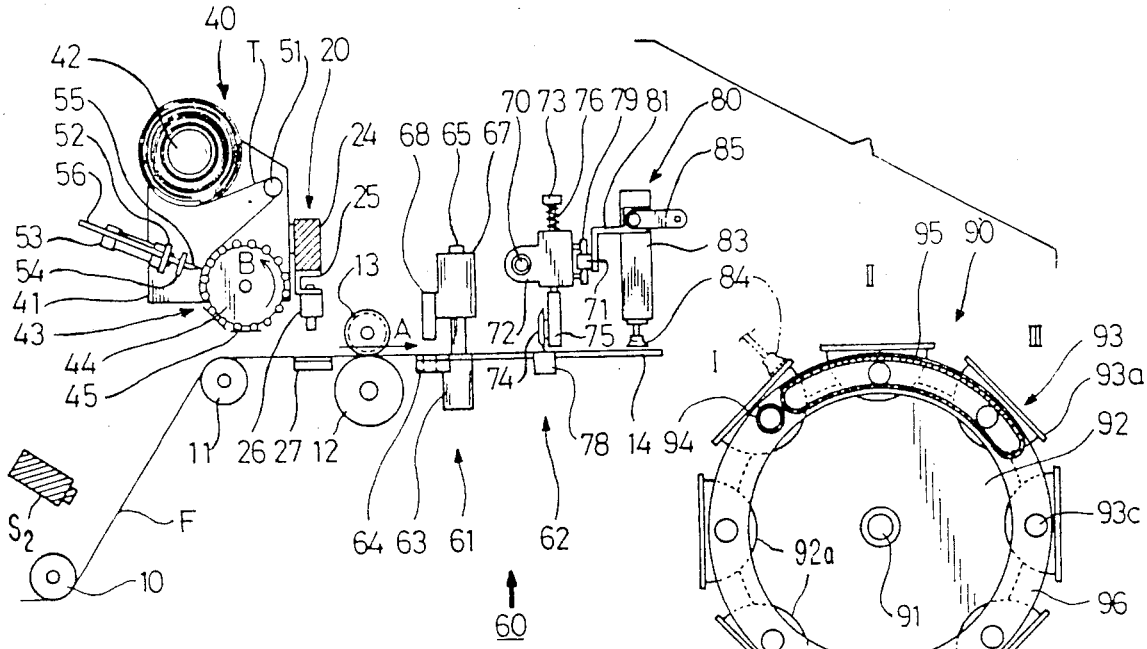
Figure 5:
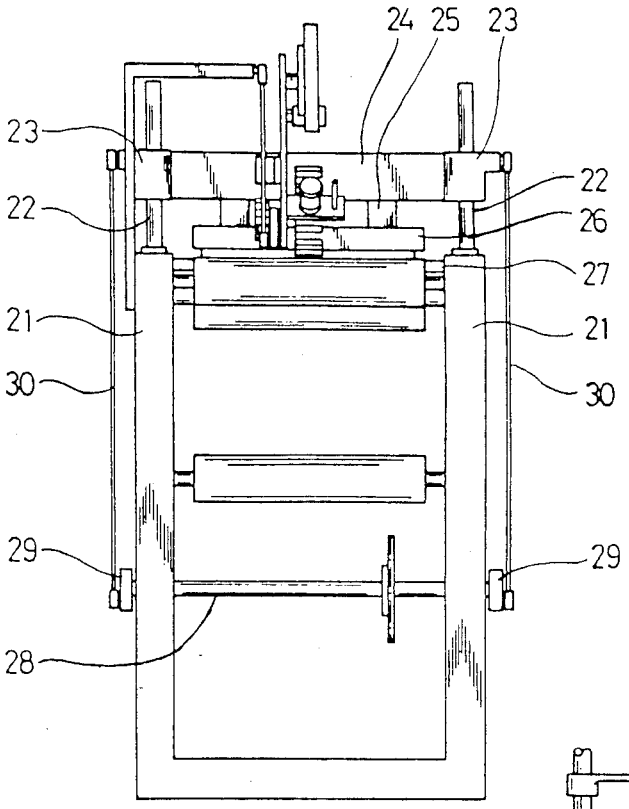
Figure 6:
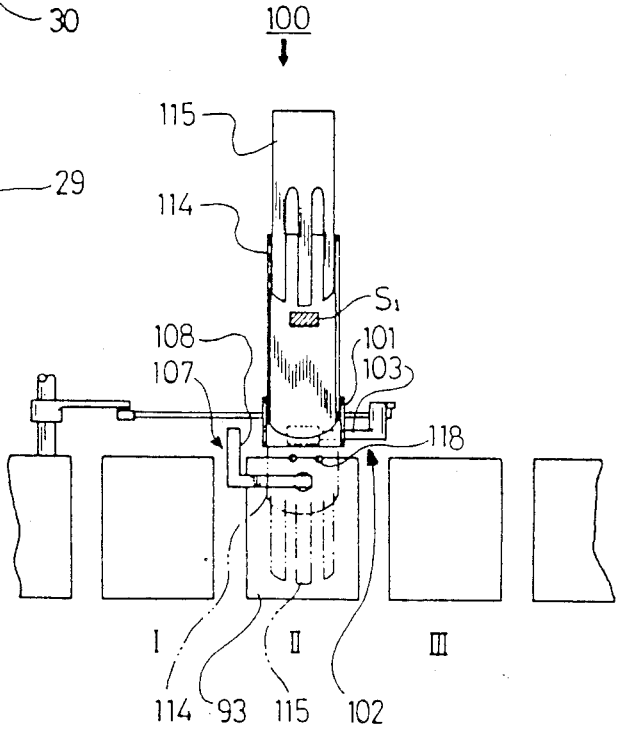
Figure 4:
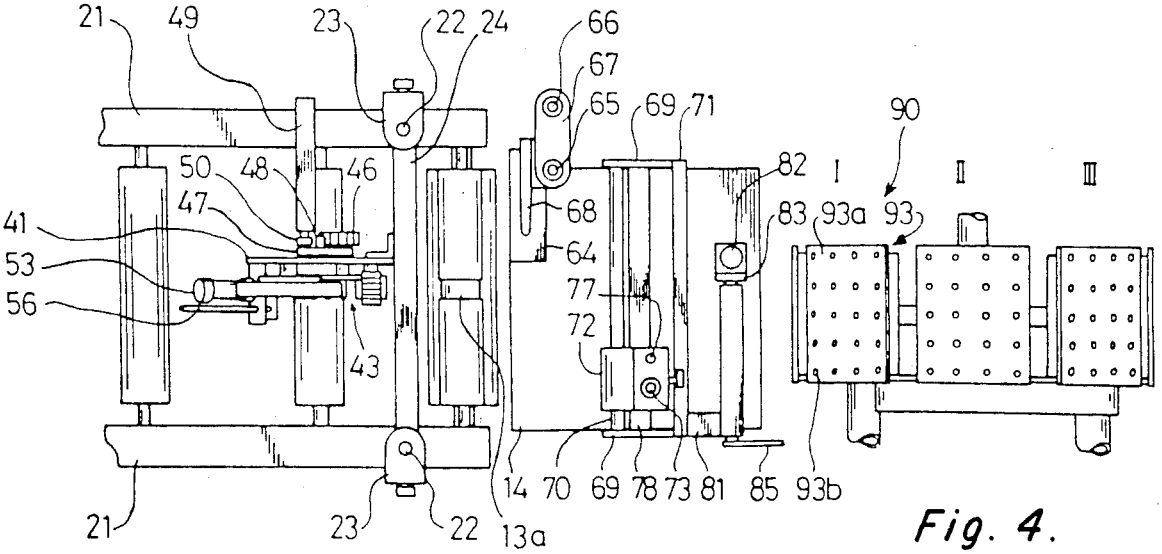

In the drawings:

FIG. 1 is a perspective view of a conventional rectangularly shaped pouch formed of plastic film for the packaging of folded hosiery therein, FIG. 2 is a perspective view of the generally square shaped pouch of the present invention formed of plastic film for the packaging of folded hose therein, FIG. 3 is a side elevational view, partly schematic, of the apparatus of the present invention for forming pouches of the present invention from plastic film, for transferring the pouches, and for inserting folded hosiery into the pouches, FIG. 4 is a plan view of the apparatus of FIG. 3, FIG. 5 is an elevational view of the end of the apparatus of of FIG. 4 at which the formation of the pouches is begun, FIG. 6 is a plan view showing steps in the insertion of folded hosiery into the newly formed pouches, FIG. 7 is a side view of the apparatus of FIG. 6, and FIGS. 8 and 9 are views showing further steps in the insertion of the folded hosiery into the pouches.

As shown in FIG. 1, hosiery H is folded about board P to form a flat rectangularly shaped unit which is inserted into a similarly shaped pouch 1 having a closing flap 2 to which spaced single-faced adhesive tapes T are attached to the back of the flap. The flap is turned to its dotted line position in which the tapes stick to and bond the flap to the pouch. It will be noted that the film of pouch 1 and flap 2 is somewhat rectalinear so that it is relatively easy to apply and to use the two tapes T to close the pouch 1 with the flap 2.

On the other hand, if hosiery H is suitably folded without a board and inserted into a substantially square shaped pouch 3 of little depth made according to the present invention, FIG. 2, the hosiery expands the pouch to pillow-like curvalinear shape along with corresponding curvature of flap 4 with the result that the sealing and bonding system used in FIG. 1 cannot be used with the pouch and flap of FIG. 2. Instead the system devised in the present invention is used to seal and to bond the pouch 3 and flap 4, as will appear.

An object of the present invention is to meet the artistic demand for a square shaped compact pouch of little depth in which the flap can be sealed to the pouch by two-faced adhesive tape stuck to the inner side of the flap and to the corresponding outer side of the pouch.

As in FIG. 3, unevenly folded plastic film F extends horizontally under tension by spaced rollers 10, 11 and a pair of feed rollers 12, 13, the arrangement being such that the film is intermittently fed under tension in the direction of arrow A by the feed rollers.

Acting in turn upon the film, starting with the supply end thereof, is an adhesive sticking member 40, a film sealing member 20, a film cutting member 60, and a pouch transfer member 80.

Referring now to the film sealing member 20 (before describing the adhesive sticking member 40), a pair of spaced guide rods 22, 22 are vertically disposed on frame members 21, 21, FIGS. 4, 5, where sliders 23, 23 slide up and down on the guide rods, the sliders being fixed to an intervening yoke 24 which moves the sliders. Heater 26 is secured to the underside of yoke 24 by brackets 25. A table 27 is horizontally supported by the frames 21, 21 for contact therewith by heater 26 when the latter moves down.

Heater 26 is caused to reciprocate vertically above table 27 by small wheels 29, 29 fixed to the opposite ends of shaft 28 rotatably journalled in the lower part of frames 21, 21, FIG. 5, the wheels being eccentrically related to vertical connecting rods 30, 30 which are also related to sliders 23, 23. Rotation of shaft 28 by suitable means, not shown, will cause heater 26 to move toward and away from the table.

Referring to the adhesive tape sticking member 40, a plate 41 is secured to and moves up and down with yoke 24 of the sealing member 20, FIG. 3. A holder 42 for double-faced adhesive tape T and a circular rotor 43 are rotatably mounted on plate 41 and move therewith. The rotor has a series of circumferentially spaced flat members or bars on its periphery to draw selected lengths of the tape from the roll thereof and to temporarily retain the tape adhered to the bars.

As in FIG. 4, a ratchet 46 is fixed to one end of the shaft of rotor 43 while one end of arm 47 is rotatably mounted on plate 41 to move up and down therewith. A pawl 48, rotatably mounted on one side of arm 47, engages with and advances ratchet 46 when arm 47 oscillates. The other end of arm 47 is connected via connecting rod 50 to a fixed bracket 49 extending vertically from frame 21. In operation, as plate 41 moves up and down with yoke 24, arm 47 turns to cause ratchet 26 to be advanced one tooth at a time by pawl 48 so that rotor 43 is turned a selected angle with each advance of the rotor. As a result, a preselected length of tape T is intermittently drawn off the roll thereof with the aid of roller 51, and is stuck onto and temporarily retained by the bars 45.

An air cylinder 53, secured to bracket 52 and moving up and down with plate 41, is directed toward rotor 43. A cutter 55 is secured to one end of the piston rod of the air cylinder via support rod 54, and a guide rod 56 is mounted upon support 54 and extends through bracket 52. The cutter is operated to cut the tape in every other space between the bars 45, and to retain the same thereon by the adhesive. It has been found unsatisfactory to cut the tape in every space between the bars because the cut section would not be securely attached to the bars if this was done. Also, it has been found that the cut lengths of tape are more securely held when bonded to a pair of adjoining bars.

The film cutting member consists of two parts 61 and 62 of which part 61 first cuts the film to provide the flaps for the pouches and of which part 62 thereafter cuts the pouches apart.

Bracket 63 of flap cutting member 61 is suitably mounted on the frame below the traveling film F and has a stationary cutter 64 incorporated therein. Guide rods 65, 66 are supported by bracket 63 to extend upwardly through a vertically movable head 67. A cutter 68, to mate with lower cutter 64, is mounted upon head 67 to move up and down therewith. Head 67 is moved up and down along guide rods 65, 66 by any suitable means. When the head moves up, film F is delivered on to stationary cutter 64 and when the head moves down the stationary and movable cutters 68, 64 cut out the film between adjacent flaps.

Pouch cutting member 62 has a parallel pair of spaced horizontal guide rods 70, 71 extending between vertical side members 69, 69 suitably anchored to the frame. A rod 73 is spring 76 urged downwardly through a suitable opening in slider 72 which moves horizontally along guide rod 70. A head 75 to support movable cutter 74 is secured to the lower end of rod 73. A vertical guide rod for slider 72 is shown at 77 and table 78 is suitably secured to the frame beneath cutter 74. A pair of guide rollers 79, 79 are rotatably supported on the opposite side of slider 72 to roll along the upper and lower faces of guide rod 71. The movable cutter 74 reciprocates along table 78 when slider 72 moves back and forth along guide rods 70, 71 by suitable means. A horizontally extending table surface is provided to support the pouches being separated by the cutting members 61, 62.

The pouches, separated by the film cutting member 60, are next operated upon by pouch delivery member 80 to deliver the same to suction boxes 93 of the following transfer member 90 from which the pouches are transferred to the position in which the folded hosiery is inserted therein. To this end, a member 83 which supports an air cylinder 82 is rotatably mounted for turning on bracket 81 which is supported on the side of guide rod 71 of pouch cutting member 62, and an air intake member 84 is attached to the end of the piston rod of such cylinder. Air cylinder 82 is mounted on bracket 81 so that it can oscillate between a position in which its end 84 faces table 14 from which it takes a pouch and a position in which its end 84 faces one of the suction boxes 93 in which it transfers the pouch thereto. Air cylinder 82, via air intake 84 in solid line position, FIG. 3, will hold a pouch by suction and transfer the pouch to the dotted line position of intake 84 on the face of a suction box 93 which will then hold the pouch, in dotted line position, as suction in cylinder is released.

The apparatus then performs the operations of transferring the pouches from member 90 to the folded hosiery inserting position 100, and then to turn the flaps of the pouches to be bonded thereto.

Transfer member 90 has a circular supporting plate 92 rotatably mounted on a horizontal shaft 91 with a series of spaced cut outs 92*a* for semi-circular shaped suction boxes 93 on its periphery. Air suction holes 93*a* are formed on the flat side of the boxes 93 to connect with holes 93*c* which connect in turn with air suction pipe 94. Intermittent stop positions of boxes 93 are provided at stations I, II and III when and where transfer operations take place. At station I air suction pipe 94 is in a connecting position to hole 93*c* of suction box 93 having stopped at station I, and another air suction pipe 95 having a wide opening extends from a position adjacent air suction pipe 94 to a position at the end of station III. A ring shaped member 96 having an air opening to connecting holes 93*c* of suction boxes 93 is secured on the side thereof to suck the air from connecting holes 93*c* by closing the opening of air suction pipe 95 except for the connection from holes 93*c* of the boxes 93.

A plurality of suction boxes of transfer member 90 are shown developed into a straight line in relation to station II at the folded hosiery insert member 100, FIGS. 6, 7. A U-shaped channel member 101 is suitably fixed to the frame of the apparatus so as to be flush with the top flat plate 93*a* of the suction box 93 in position at station II. A retaining member 102 pushes flap 4 of the pouch (held by air to a box 93) to the underside of the channel 101 to retain the pouch in place. An oscillating lever 103 of retainer 102 pushes flap 4 of the pouch with a synthetic rubber element 103*a* secured to the free end of the lever 103. Dotted and full line positions of lever 103 are shown in FIG. 7. The other end of lever 103 is connected via connecting rid 106 to the end of cam lever 105 which oscillates in response to movement of cam 104, FIG. 7, to allow lever 103 to be moved in time with the rotating cam.

An air suction filter 109 of pouch opener 107 depends from arm 108 over the top plate 93*a* of box 93 to lift the upper film of the pouch to open the mouth thereof at station III. Arm 108 is secured to the upper end of an arm 110 which is connected by rod 113 to to pivoting lever 112 which is raised and lowered by rotary cam 111 to raise and lower lifter 109 in timed relation.

A slide having a cross sectional shape similar to guide member 101 is arranged to fit in and to reciprocate lengthwise thereof as shown in dotted and full lines in FIG. 6. Slide 114 moves toward suction box 93 to be inserted into the mouth of the pouch to keep it in the position as opened by opener 107. Inserting plate 115 sliding along guide 114 is arranged so as to also oscillate vertically from the rear end thereof above guide 114 by a suitable cam mechanism (not shown) in the course of moving along guide 114, so that upon placement of the folded hosiery on slide 114, the inserting piece 115 may turn to push the hosiery against the guide and slide it toward the open mouth of the pouch with the guide 114 guiding the ends of the hosiery. Two grooves 115*a*, 115*a* are formed in the inserting plate 115.

As in FIGS. 6, 7 a hosiery retainer 116 is disposed above a box 93 to temporarily retain the hosiery already inserted in the pouch by the inserting member 100 and to aid in drawing the inserting plate 115 out of the pouch. An air cylinder 117 is mounted on a suitable frame to face downwardly with two retaining rods 118, 118 extending from the air cylinder 117 and are so arranged to move up and down above box 93 at station II by means of air cylinder 117.

A flap sealing member 120, FIG. 8, at station III of the transfer member 90 is made up of a pouch expander 121 to flatten the pouch and of a flap turner 122 to turn the flap toward the body of the pouch to join the flap to the adhesive tape.

In the pouch expander 121, angled bracket 123 suitably secured to the frame (not shown) extends over a suction box 93 at station III of transfer member 90, FIGS. 8, 9. An oscillator 124 is rotatably mounted on bracket 123 as shown in FIG. 9 with the boxes in developed position. An air cylinder 125 is anchored to face downwardly above oscillator 124. A pair of arms 126, 126 rotatably mounted on the two bottom sides of the oscillator are connected to the end of the piston rod through a suitably formed slot formed on the top ends of the pair of arms 126, 126 whereas rods 127, 127 are secured to the bottom ends of the pair of arms 126, 126 to be inserted toward the interior sides of the pouch. The free ends of rods 127, 127 are bent toward a box 93 to be inserted adjacent the interior sides of the pouch. The arrangement is such that upon activating air cylinder 125 the arms 126, 126 move downwardly at an angle to spread apart the rods 127, 127.

Arm 128 is formed integrally with the axis side of the oscillator 124 and an auxiliary bracket 129 is secured to the top of bracket 123. An air cylinder 130 is rotatably mounted upon bracket 129 and its piston rod is connected to the end of arm 128 so that, upon activating air cylinder 130, the oscillator 124 is operated to cause rods 127, 127 to oscillate between the solid and dotted line positions as seen in FIG. 8. Dotted line position of rod 127 shows where the end of rod 127 is inserted into the pouch.

Referring now to flap turner 122, a flap suction box 131 with air suction holes on its upper side is placed above suction box 93 at station III of transfer member 90, FIG. 8, the box 131 being anchored upon the end of the piston rod of an air cylinder 133 which is supported by arm 132 which is rotatably secured to a suitable fixed part of the frame. Flap turner 122 is so made that box 131 may oscillate upwardly to push flap 4 of the pouch which has been expanded and flattened by pouch expander 121, and that activation of air cylinder 133 will cause box 131 to move back and forth along the pouch up to the dotted line position of FIG. 8.

The operation of the present apparatus will now be set forth. Ribbon-like plastic film F of indefinite length which has been folded back on a lengthwise extending fold line with the bottom side wider than the top side is drawn over a pair of rollers 10, 11 in direction A by a pair of intermittently operated feed rollers 12, 13.

The feed rollers 12, 13 to feed plastic F and the described components of the apparatus will start their respective operations momentarily when photo sensor S1 above guide 114 of the hosiery inserting member 100, FIG. 6, detects that the folded hosiery has been fed onto guide 114 before being inserted into the pouch. Feed rollers 12, 13 are caused to stop momentarily when photo sensor S2, FIG. 3, detects each of spaced check marks on the film, the spacing of the marks corresponding to the formation of individual pouches.

Upon detection of the hosiery by sensor S1 all members of the apparatus start together to perform their regular operations. Heater 20 moves down to film F to press it on table 27 causing top and bottom parts of the film to be heat sealed together to form the pouch. Then adhesive tape sticking member 40, in linkage with heater 20, moves down to film F to stick one face of a cut piece of the double-faced adhesive tape T to the film, the tape having been on a pair of bars 45, 45 on the bottom of rotor 43. After heater 20 has sealed the film, tape member 40 moves up to cause arm 47 to advance rotor for a two-pitch movement of rotor 43. Thus a new piece of tape attached to the bars reaches the bottom of rotor 43 and at the same time a length of tape is drawn from the tape roll to be retained by the bars 45. Upon return of plate 41, cylinder 53 is activated to cause cutter 55 to cut the adhesive tape between a pair of bars in preparation for the next pouch to be made. Cutter 55 acts in every two spaces between bars 45 and each piece of adhesive is stuck to the top piece of film F by the downward movement of plate 41, and when plate 41 moves up the tape is transferred from the bars 45.

The film, with the double walled portion thereof heat sealed at spaced crosswise extending intervals to form connected pouches and with a piece of tape stuck to the top side of each pouch, is advanced by feed rollers 12, 13 along table 14 in direction A toward flap cutter 61. Flap cutter 61 acts upon the single wall of film extending from one wall of the still connected (by heater 20) sealed pouches made of only the folded portion of the film F. By using any desired shapes for the outline of cutters 64, 68, a selected outline of the flaps, such as a U-shape, can be had when head 67 moves downwardly. Pouch cutting member 62 separates the pouches by cutting along the heat seals therebetween by the rollong action of circular cutter 74 on table 14. The pouches are now completely separated.

With the separated pouches on table 14 under delivery member 80, a corner of the pouch is caused to adhere by suction to a suction member 84 on the end of piston rod of air cylinder 82, when the rod is lowered. Then the air cylinder is activated to be moved and to extend its piston rod so that suction member 84 moves to its dotted line position in FIG. 3. In such dotted line position the pouches is held to the flat face of suction box 93 then at station I after suction is released from suction member 84. Then air cylinder 82 is returned to its full line position of FIG. 3 ready for the next pouch.

Suction pipe 94 connects in turn only with hole 93*c* of the particular suction box 93 then in station I. Suction box 93 starts suction immediately after cessation of suction by suction member 84 so as to keep pouch 4 flat on the face of suction box after pouch 4 has been transferred thereto by suction member 84. Suction pipe 95 keeps suction on in those of the suction boxes which pass by pipe 95 at stations I, II and II via the holes 93*c* therein.

When box 93, which received a pouch from member 84 at station I, moves to station II, the pouch flap enters beneath the channel shaped frame member 101 and crank arm 103 of retainer 102 moves from its sold line to its dotted line position, FIG. 7, to temporarily press and retain the flap beneath member 101. Then suction member 109 of the opener 107 above the suction box at station II moves down close to the top wall or piece of the pouch near the opening therein. The pouch is then being held on the face of box 93 by suction and member 109 engages with the upper layer of the pouch and moves upwardly to raise such layer and thereby to open the mouth of the pouch.

After guide 114 is inserted into the open mouth of the pouch to its dotted line position in FIG. 6, inserting plate 115 moves along with guide 114, or slightly behind the same, while the mouth of the pouch is kept open. Thus inserting plate 115 oscillates downwardly to press and to retain the folded hosiery prior to insertion of the same to the dotted line position in the pouch as shown in FIG. 6 wherein guide 114 acts as a guide for the sides of the hosiery. When guide 114 is inserted into the opened mouth of the pouch, suction is released in member 109 to release the top layer of the pouch, and, after the hosiery has been inserted into the mouth, crank arm 103 is operated to release the flap.

Plate 115 returns to its starting position after retaining rods 118, 118 have been inserted in cut outs 115*a*, 115*a* of plate 115 by action of air cylinder 117, so that the hosiery inserted into the pouch is kept therein. Moving with, or slightly behind plate 115, guide 114 is drawn out of the mouth of the pouch and returns to its starting position.

When the hosiery is inserted into the pouch of FIG. 2, suction box 93 moves from station II to station III where turning member 120 will turn the flap toward its closing position in which it will contact the double-faced adhesive tape T on the outer side of the body of the pouch to seal the flap to the body by the adhesive on the tape. Flap 4 has been held by suction member 131, FIG. 8, while box 93 moves to station III.

Activation of air cylinder 130 moves a pair of rods 127, 127 from solid to dotted line positions of FIG. 8 wherein the rods are placed into the interior sides of the pouch and are expanded to move away from each other thereby to flatten the pouch and the hosiery therein.

Then suction member 131 holding flap 4 is raised by upward oscillation of arm 132 and is moved forward to its dotted line position in FIG. 8 by activation air cylinder 133 with the result that the flap is turned toward the top surface of the pouch and is attached thereto by the adhesive on one side of the double-faced adhesive tape to seal the pouch.

After the pouch has been sealed, rods 127, 127 return to their solid line position in FIG. 8 by the return movement of cylinder 130 and are moved from expanded to contracted positions by the return of cylinder 125. Also, by the return of cylinder 133 and down turn of arm 132, suction member 131 returns to its solid line position in FIG. 8. Suction in member 131 ceases when the flap is sealed.

After the pouch is sealed, box 93 with the sealed pouch thereon moves onward from station III to the next position, however, because there is no air suction in such next position (from suction pipe 95) the sealed pouch will drop from box 93 into any suitable container.

As described, a separate flap cutting member 61 and a separate pouch cutting member 62 are provided so that the edges of the flaps may be shaped as desired by accordingly changing the shape of the cooperating cutters 64, 68 to provide for V or U or other shaped cut outs. If it is desired to cut both pouch and flap in the same operation, this can be done at member 62 by the wheel 74 which will then cut both the pouch and flap in a single operation.

The tape member 40 is first among the positions of all of the members of the apparatus. Plate 41 reciprocates through suitable linkage with reciprocating yoke 24 of heater 20. Tape member 40 may be in any location so long as it is prior to the insertion of hosiery into the pouch, in which case separate means is required to activate plate 41, as well as to press the pouches after they are cut off.

It will be noted that the tape can be stuck to the top piece of the doubled back film F before the film is made into the pouch, or to the top side of the pouch before hosiery is inserted therein, in either case the tape will be accurately located even if the pouch becomes bulky after the pouch has been inserted therein.

It will also be noted that because the hosiery is inserted into the pouch while the latter is held by suction, and because the loaded pouch is also held by suction as it is moved to sealing position, re-positioning of the pouch during the flap turning is eliminated. The sealing member 120 including pouch expander 121 and flap turner 122 provide accurate flap turning and subsequent bonding thereof to complete the sealing operation.

We claim:

1. Apparatus for packaging folded hosiery in a pouch, said apparatus comprising pouch forming means to automatically form pouches and pouch closing flaps of a lengthwise extending sheet of plastic film of indefinite length doubled back on itself along a lengthwise extending off center fold line to provide a pair of doubled film layers of the film extending from the fold line and to provide a single layer flap of the film in lateral extension of one of the doubled film layers, means for applying one face of a double-faced adhesive tape to the other of the doubled film layers, means for automatically inserting folded hosiery into the so formed pouches with the double-faced adhesive tape applied to said other of the doubled film layers, and means for thereafter closing the pouches with the flaps so that the flaps are adhesively attached to the other face of the double-faced adhesive tape.

2. Apparatus as in claim 1 wherein a rotor draws off the double-faced adhesive tape from a roll thereof onto itself, wherein a cutter forms sections of the double-faced adhesive tape, and wherein the rotor transfers the double-faced adhesive tape sections from itself to the other of the doubled film layers.

3. Apparatus as in claim 2 wherein a heat sealing member seals the doubled film layers together along transversely extending spaced lines thereby to form connected pouches of the film, and wherein the pouches so sealed have a pocket therein between the doubled film layers.

4. Apparatus as in claim 3 wherein a film cutting unit severs the connected pouches along the spaced lines thereof and severs the single layer of film along corresponding lines thereby to form individual pouches and attached pouch closing flaps.

5. Apparatus as in claim 1 including an endless series of suction boxes to which the pouches and the flaps are yieldingly retained by suction while the folded hosiery is being inserted into the pouches.

6. Apparatus as in claim 5 wherein a fixed guide member is provided for a movable guide member and wherein the flaps are temporarily disposed beneath the fixed guide member.

7. Apparatus as in claim 6 wherein an opener engages one layer of the pouch to open the mouth of the opening therein.

8. Apparatus as in claim 7 wherein the movable guide member is guided by the fixed guide member to enter into the mouth of the pouch to maintain the same in opened condition.

9. Apparatus as in claim 8 wherein a hosiery inserting plate with the hosiery thereon is guided by and moves with the movable guide to insert the hosiery into the pouch.

10. Apparatus as in claim 9 wherein a retaining member temporarily retains the hosiery in the pouch while the inserting plate is being withdrawn from the pouch.

11. Apparatus as in claim 10 wherein the flap is moved from beneath the fixed guide toward the pouch to cause the flap to be adhesively attached to the other face of the double-faced adhesive tape then on the pouch.

12. Apparatus as in claim 11 wherein the suction is released from the suction box thereby to permit removal by gravity of the packaged hosiery therefrom.

13. Apparatus as in claim 12 including a transfer arm to which the pouch and flap is yieldingly attached to said transfer arm by suction, wherein said transfer arm transfers the pouch and flap to said suction boxes to which it is yieldingly attached by suction in the boxes, and wherein the suction in said transfer arm is then released.

* * * * *